United States Patent [19]

Malcolm

[11] Patent Number: 4,623,071

[45] Date of Patent: Nov. 18, 1986

[54] HINGE FOR BLOW-MOLDED CASES

[75] Inventor: Donald A. Malcolm, Roanoke Rapids, N.C.

[73] Assignee: W. R. Grace & Co.

[21] Appl. No.: 793,049

[22] Filed: Oct. 30, 1985

[51] Int. Cl.[4] ..... B65D 43/14; B65D 51/04

[52] U.S. Cl. ..... 220/337; 220/4 E

[58] Field of Search ..... 220/337, 4 E; 16/171

[56] References Cited

U.S. PATENT DOCUMENTS 3,295,713 1/1967 Optner ..... 220/337

*Primary Examiner*—George T. Hall

*Attorney, Agent, or Firm*—John J. Toney; William D. Lee, Jr.; Mark B. Quatt

[57] ABSTRACT

A thermoplastic container has separate hinge means in the body and cover portions of the container which are similar or substantially identical. This four part hinged configuration simplifies tooling, and simplifies economy of production, while allowing easy assembly of the container and resulting in a secure hinge after assembly.

11 Claims, 6 Drawing Figures

FIG. 3
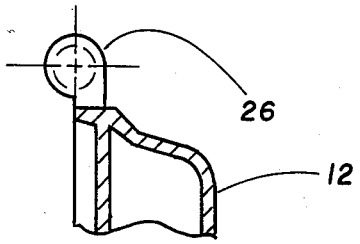
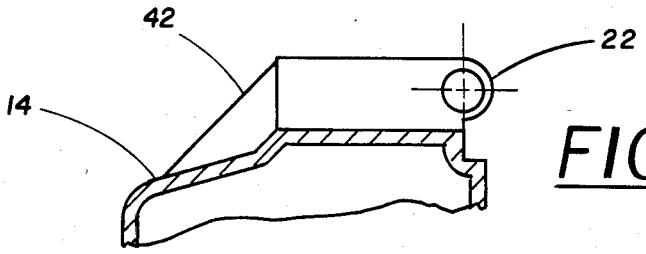
FIG. 4
FIG. 5
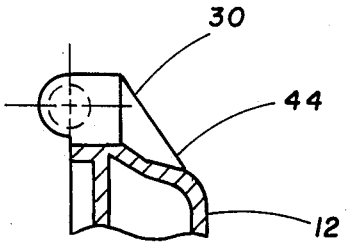
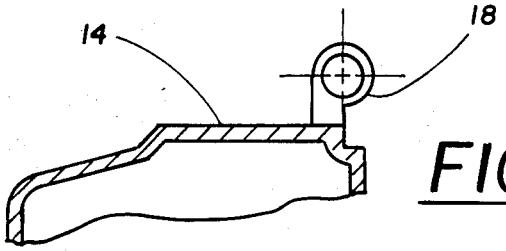
FIG. 6

HINGE FOR BLOW-MOLDED CASES

BACKGROUND OF THE INVENTION

This invention relates generally to thermoplastic containers, and more particularly to a new and improved hinge means for blow-molded cases.

Blow-molded containers are commonly used in packaging articles which require some measure of protection against shock and abuse during storage and shipping.

Often, these blow-molded containers are of double wall construction to enhance the cushioning effect of the container while also providing shaped areas of the article to be carried in the container. Typically, these containers are blow-molded into a cover portion, a body portion, and an integral hinge arrangement. Alternately, the body portion and cover portion are separately molded, and a hinge may either be formed integrally on each portion, or may be separately attached to each portion to provide a hinge means for opening and closing the container after joining the body portion and cover portion.

One such example of a container with discrete body and cover portions is described in U.S. Pat. No. 4,005,800 (Schurman) which describes a container in which a cover portion has an integral hinge with a pair of hinge pins extending from either end thereof, and a body portion having receiving means for the hinge pins.

U.S. Pat. No. 4,078,657 (Schurman) describes a similar arrangement.

Also of interest is U.S. Pat. No. 4,211,337 (Weavers et al) which describes a plastic box having an integral hinge on one part of the box having two separate and spaced apart spines with a pin on each spine projecting toward the outside edge of the container. The other part of the box contains a projection which fits between the two spines of the first part of the box, as well as receiving means for the pins.

These and similar designs make use of integral hinge means in which the total configuration of the hinge means of a cover part and a body part of a plastic container are radically different in design. It would be highly desirable for the sake of economy and simplicity to provide a hinge arrangement in which the body portion and cover portion of a thermoplastic container were essentially identical, or at least similar, particularly with respect to the hinged area of the container.

The prior designs also have the problem of some difficulty in actual assembly of the two halves of the thermoplastic container. It would therefore also be beneficial to provide a hinge arrangement wherein the two halves of the container, i.e. the body portion and cover portion could be relatively easily assembled while still providing a container in which, after assembly, the container is securely attached and permits opening and closing the container without the danger of separation of the body and cover portions.

It is, therefore, an objective of the present invention to provide a container in which both halves of the container have essentially the same, or at least similar, hinge configuration in order to provide simplified and economic tooling of the container parts.

It is also an objective of the present invention to provide a container in which the hinge configuration allows for relatively easy assembly yet provides a secure hinge after assembly which will not easily separate during use.

SUMMARY OF THE INVENTION

In accordance with the present invention, a thermoplastic container contains a body portion, a cover portion, and hinge means, the hinge means further comprising four pivotally interlocking hinge portions which prevent separation of the body portion and cover portion while permitting opening and closing of the container.

BRIEF DESCRIPTION OF THE DRAWINGS

Further details are given below with reference to the drawings wherein:

FIG. 3 is a cross-sectional view of a hinge portion of the rear wall of the cover portion of the container;

FIG. 4 is a cross-sectional view of a hinge portion of the rear wall of the body portion of the container;

FIG. 5 is a cross-sectional view of another hinge portion of the rear wall of the cover portion of the container; and FIG. 6 is a cross-sectional view of another hinge portion of the rear wall of the body portion of a container.

DESCRIPTION OF THE PREFERRED EMBODIMENTS

Figure 1:
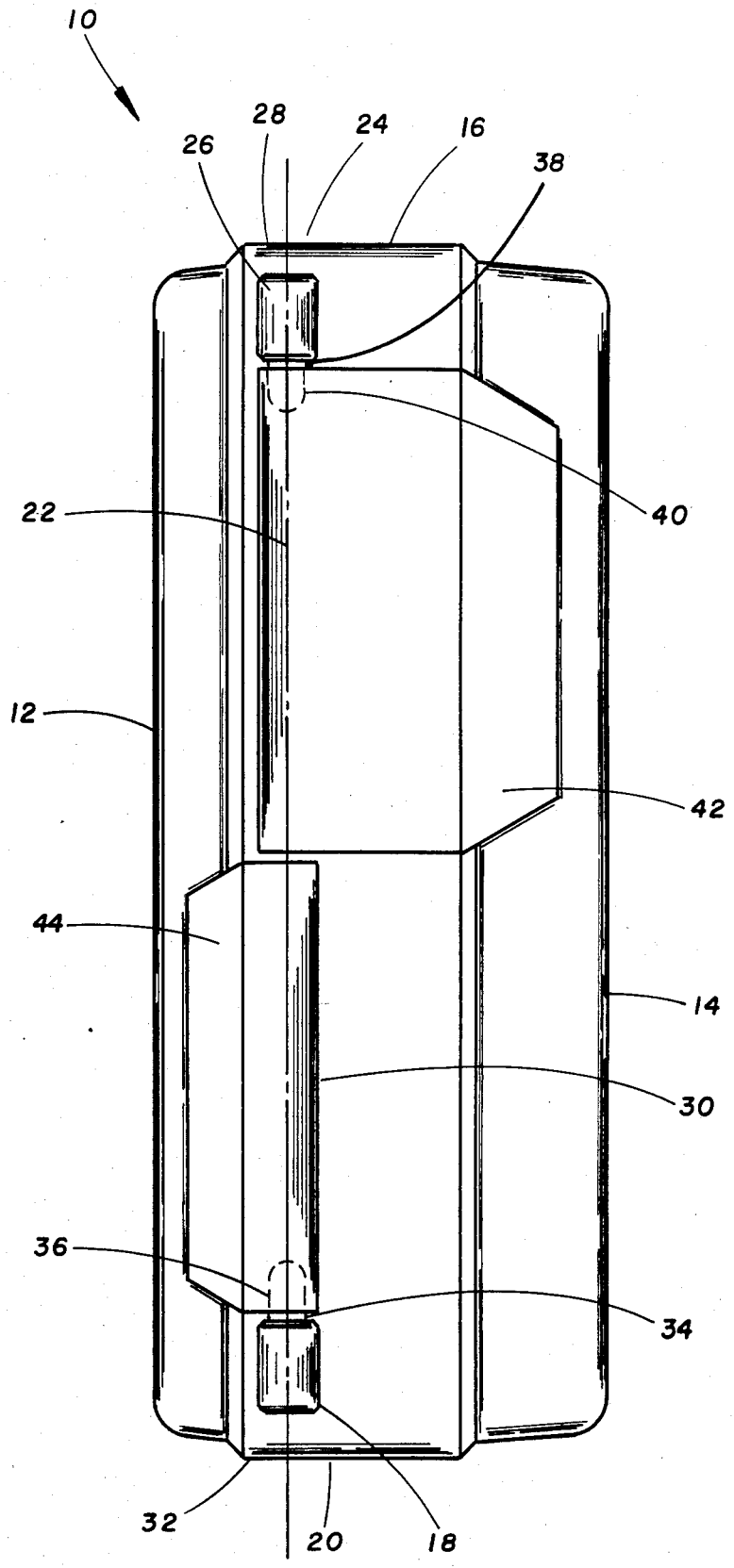
FIG. 1 is an end view of a plastic container in accordance with the present invention.
Figure 2:
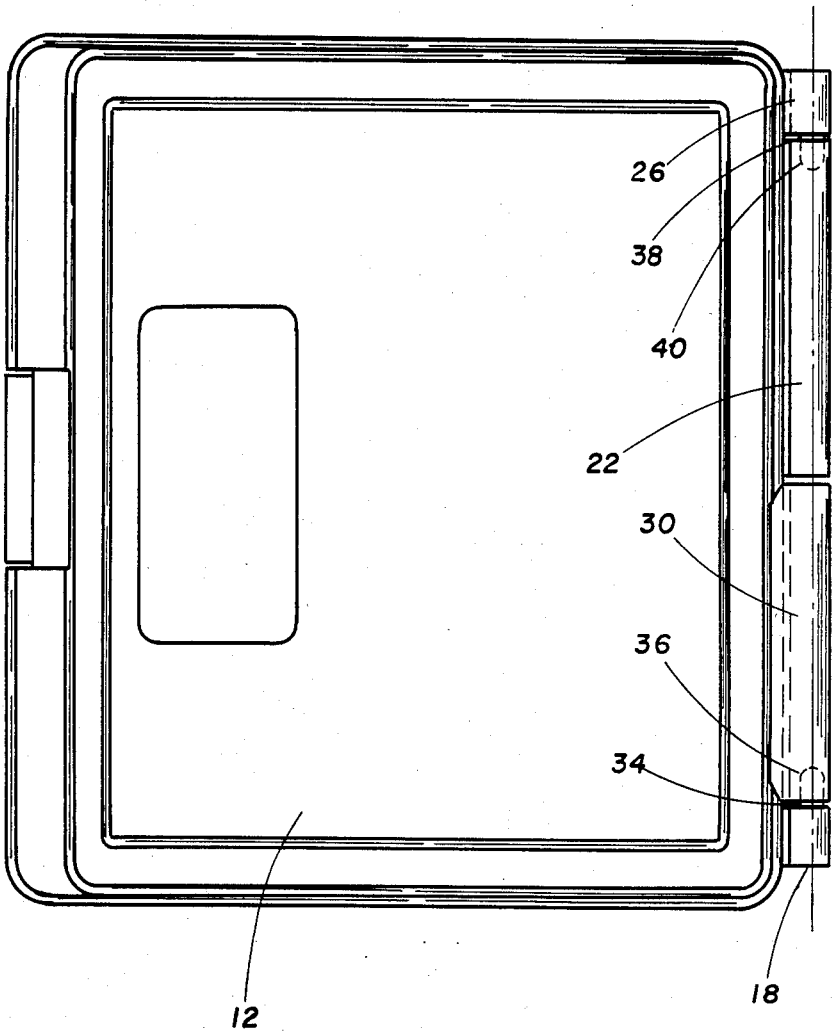
FIG. 2 is a top plan view of a plastic container in accordance with the present invention.

Referring to the drawings, in FIGS. 1 and 2 an end view and top plan view respectively of a plastic container is shown, having an improved hinge.

The plastic container 10 has a cover portion 12 and a body portion 14, with a front wall (not shown) having suitable latching means, and a rear wall 16. The hinge is mounted, preferably moldably mounted, on rear wall 16. Thus, the improved hinge arrangement preferably forms an integral part of the rear wall 16 of the cover portion 12 and body portion 14 of container 10, and the hinge portions can be, for example, blow-molded at the same time the plastic container is formed by a blow molding or other suitable process.

The improved hinge includes a first hinge portion 18 forming an integral part of the rear wall 16 of body portion 14, and disposed at or near a first corner 20 of body portion 14.

A second hinge portion 22 extends from the center of the rear wall 16 of body portion 14 and towards a second corner 24 of the body portion 14, and spaced from the second corner 24 a distance substantially equal to the sum of the length of the first hinge portion 18 and the distance of the first hinge portion 18 from the first corner 20 of body portion 14.

The cover portion 12 of container 10 has along rear wall 16 a similar hinge arrangement to the arrangement described above. A third hinge portion 26 is disposed near a first corner 28 of cover portion 12, and a fourth hinge portion 30 extends from the center of the rear wall 16 of cover portion 12, and towards a second corner 32 of cover portion 12 and spaced from second corner 32 a distance substantially equal to the sum of the length of the third hinge portion 26, and the distance of the third hinge portion 26 from the first corner 28 of the cover portion 12.

Each of hinge portions 18, 22, 26, and 30 includes fixing means to permit easy assembly of the container, yet provide an interlocking feature making inadvertent disassembly of the container very difficult.

The fixing means includes a first protrusion 34 extending from an end of first hinge portion 18, and towards the second hinge portion 22, i.e. towards the center edge of the rear wall 16. This protrusion is preferably a pin or similar device which is accommodated during assembly into a first recess 36 disposed in a facing end of fourth hinge portion 30.

Likewise, hinge portions 22 and 26 have a protrusion 38 and recess 40 respectively, which interlock during assembly of the container. Second protrusion 38 is also preferably a pin or similar device. The protrusions 34 and 38 are substantially parallel to the rear wall 16 of the container 10.

The improved hinge arrangement as described above results in a body portion 14 having a hinge portion with a protrusion, and another hinge portion with a recess. Cover portion 12 also has a similar arrangement, one hinge portion having a protrusion and one hinge portion having a recess.

Hinge portions 18, 22, 26 and 30 may be of equal length, although for ease of assembly it is preferred that first hinge portion 18 and third hinge portion 26 are shorter in length, for example $\frac{1}{2}$ to $\frac{1}{3}$ the length of second hinge portion 22 and fourth hinge portion 30. First and third hinge portions 18 and 26 are substantially the same length, as are second and fourth hinge portions 22 and 30.

An advantage of the present invention is the ease with which the cover portion 12 and body portion 14 of the plastic container may be assembled.

The respective parts of the container are brought together, and the first protrusion 34 of first hinge portion 18 is inserted into the first recess 36 of fourth hinge portion 30.

Before this step is completed, i.e. before the entire length of first protrusion 34 is inserted into first recess 36, second protrusion 38 of third hinge portion 26 is inserted into second recess 40 of second hinge portion 22. This second step involves some flexing of the cover portion 12 and body portion 14 of container 10.

The cover and body portions 12 and 14 are then slid together to completely engage the protrusion/recess pairs, and the adjacent surfaces of second and fourth hinge portions 22 and 30 are then displaced to lock the respective hinge portions in place to form a pivotal hinge.

To facilitate assembly, first protrusion 34 is preferably somewhat longer than second protrusion 38.

This assembly results in a hinge means having four pivotally interlocking hinge portions which prevent separation of the body and cover portions of the container, yet permit opening and closing of the container.

Second hinge portion 22 can include a tapered section 42 which tapers into the body portion 14 of container 10. Fourth hinge portion 30 can also include a tapered section 44 which tapers into the cover portion 12.

Although the present invention has been described in connection with the preferred embodiments, it is to be understood that various changes and modifications may be made without departing from the principles and scope of the invention, as those skilled in the art will readily understand after the review of the invention. For example, the location of protrusions and recesses as described above may be interchanged. Such changes and modifications may be practiced within the scope of the following claims:

I claim:

1. A thermoplastic container comprising a body portion, a cover portion, and segmented hinge means, the hinge means further comprising:

(a) a first hinge portion near a first corner of the body portion;

(b) a second hinge portion extending from the center of the body portion and towards a second corner of the body portion, and spaced from the second corner a distance substantially equal to the sum of (1) the length of the first hinge portion and (2) the distance of the first hinge portion from the first corner of the body portion;

(c) a third hinge portion near a first corner of the cover portion; and (d) a fourth hinge portion from the center of the cover portion and towards a second corner of the cover portion and spaced from the second corner a distance substantially equal to the sum of (1) the length of the third hinge portion and (2) the distance of the third hinge portion from the first corner of the cover portion;

the first, second, third and fourth hinge portions each including fixing means to pivotally interlock the hinge means during assembly and prevent separation of the body portion and cover portion while permitting opening and closing of the container.

2. A container according to claim 1 wherein the body portion and cover portion are of double-wall construction.

3. A container according to claim 1 wherein the fixing means comprises a first protrusion extending from an end of the first hinge portion closest to the second hinge portion; a first recess disposed in an end of the fourth hinge portion closest to the second corner of the cover portion; a second protrusion extending from an end of the third hinge portion closest to the fourth hinge portion; and a second recess disposed in an end of the second hinge portion closest to the second corner of the body portion.

4. The fixing means according to claim 3 wherein the first protrusion and second protrusion are of unequal length.

5. A container according to claim 1 wherein the fixing means comprises a first recess disposed in an end of the first hinge portion closest to the second hinge portion; a first protrusion extending from an end of the second hinge portion closest to the second corner of the body portion; a second recess disposed in an end of the third hinge portion closest to the fourth hinge portion; and a second protrusion extending from an end of the fourth hinge portion closest to the second corner of the cover portion.

6. The fixing means according to claim 5 wherein the first protrusion and second protrusion are of unequal length.

7. The fixing means according to claims 3, 4, 5 or 6 wherein the protrusions are disposed substantially parallel to the rear wall of the container.

8. A container according to claim 1 wherein the first hinge portion and second hinge portion of the body portion of the container are of unequal length.

9. A container according to claim 1 wherein the third hinge portion and fourth hinge portion of the cover portion of the container are of unequal length.

10. A method of connecting a body portion and a cover portion of a thermoplastic container, said body portion including a first hinge portion having a protrusion and a second hinge portion having a recess; and said cover portion including a third hinge portion having a protrusion, and a fourth hinge portion having a recess, the method comprising:

(a) inserting the protrusion of the first hinge portion into the recess of the fourth hinge portion;

(b) before completion of step (a), bringing the protrusion of the third hinge portion into engagement with the recess of the second hinge portion;

(c) completing step (a) by displacing the body and cover portions a distance sufficient to bring the first and fourth hinge portions, and second and third hinge portions into abutting relationship; and (d) displacing adjacent surfaces of the second and fourth hinge portions in order to lock the hinge portions in place to form a pivotal hinge.

11. A method according to claim 10 wherein step (b) is accomplished by the flexing of the body portion and cover portion of the container.

* * * * *

Disclaimer 4,623,071.— *Donald A. Malcolm,* Roanoke Rapids, N.C. HINGE FOR BLOW-MOLDED CASES. Patent dated Nov. 18, 1986. Disclaimer filed Jan. 23, 1989, by the assignee, W.R. Grace & Co.

Hereby enters this disclaimer to claims 1, 3, 5, 7, 8, and 9 of said patent.

[*Official Gazette August 8, 1989* ]